US006685529B1

(12) United States Patent
Sarabia

(10) Patent No.: US 6,685,529 B1
(45) Date of Patent: Feb. 3, 2004

(54) TOY STORAGE APPARATUS

(76) Inventor: Angela Sarabia, 1408 SW. 68th St., Oklahoma City, OK (US) 73159

( * ) Notice: Subject to any disclaimer, the term of this patent is extended or adjusted under 35 U.S.C. 154(b) by 0 days.

(21) Appl. No.: 10/455,762

(22) Filed: Jun. 6, 2003

(51) Int. Cl.[7] ..... B65D 79/00
(52) U.S. Cl. ..... 446/75
(58) Field of Search ..... 446/71, 73, 74, 446/75, 76; 206/579, 457

(56) References Cited

U.S. PATENT DOCUMENTS 4,131,227 A 12/1978 Patton et al.
4,755,159 A 7/1988 Templeton et al.
4,861,305 A * 8/1989 Wilson ..... 446/75
D324,085 S 2/1992 Morton
D328,201 S 7/1992 Ryan
5,458,521 A 10/1995 Todd
D365,701 S 1/1996 Keola
D381,223 S 7/1997 Brunner et al.
6,027,392 A * 2/2000 Ruhlman ..... 446/75
6,056,148 A 5/2000 Ferguson et al.
6,328,157 B1 * 12/2001 Tolver ..... 206/216
6,439,946 B1 8/2002 Schneider

* cited by examiner

*Primary Examiner*—Jacob K. Ackun
(74) *Attorney, Agent, or Firm*—John Gugliotta; Olen L. York, III

(57) ABSTRACT

A vertically disposed transparent storage volume is affixed to a reservoir radially extended from the storage volume container sidewall and has a recessed opening covered by a pivoting enclosure with a handle.

3 Claims, 2 Drawing Sheets

TOY STORAGE APPARATUS

RELATED APPLICATIONS AND DISCLOSURES

The present invention was first described in Disclosure Document Registration 520,168 filed on Oct. 16, 2002 under 35 U.S.C. §122, 37 C.F.R. §1.14 and MPEP §1706. There are no previously filed, nor currently any co-pending applications, anywhere in the world.

BACKGROUND OF THE INVENTION

1. Field of the Invention

The present invention relates generally to storage apparatuses, and, more particularly, to a toy storage apparatus comprising an base supporting an upwardly extending container with a lid.

2. Description of the Related Art

A number of variously styled and configured toy storage devices are well known in the prior art. Many devices include the typical rectangular shape with a top lid or enclosure that pivots between a closed and opened position or is detachable. Further, many of these devices included compartmentalized pockets or sections for orderly placement of toys and games.

However, at least one identifiable problem with currently available toy storage-devices is the size and amount of space that such devices occupy within a room, while not maximizing vertical storage space. Furthermore, most toy storage devices are not transparent and prevent the parent and/or child from viewing the contents of the storage device without first removing or raising the lid and then parsing through the stored toys. Wasted time and effort may result in a fruitless search for a prized or desired toy. Finally, most toy storage devices are of such size and bulk that, when partially or fully filled with toys are difficult to move.

A search of the prior art did not disclose any patents that read directly on the claims of the instant invention; however, the following references were considered related:

- U.S. Pat. No. 6,439,946, issued in the name of Schneider, discloses a child's toy with an internal cavity accessible wherein objects may be stored;
- U.S. Pat. No. 6,056,148, issued in the name of Ferguson et al., discloses a toy box with a transparent and hollow spherical member having an interior chamber for receiving toys and an aperture selectively opened and closed to expose or store the contents therein;
- U.S. Pat. No. 5,458,521, both issued in the name of Todd, discloses a combination storage container and educational toy, wherein the container includes removable components that many be assembled to and removed from the container to form different objects;
- U.S. Pat. No. 4,755,159, issued in the name of Templeton et al., discloses a carrying case that may be used as a toy building or playground;
- U.S. Pat. No. 4,131,227, issued in the name of Patton et al., discloses a carrying and storage case for audio visual teaching aids fabricated from three interlocking sheets of corrugated cardboard;
- U.S. Pat. No. Des. 381,223, issued in the name of Brunner et al., discloses an ornamental design for a toy chest;
- U.S. Pat. No. Des. 365,701 issued in the name of Keola, discloses an ornamental design for a toy chest;
- U.S. Pat. No. Des. 328,201, issued in the name of Ryan, discloses an ornamental design for a toy box; and
- U.S. Pat. No. Des. 324,085, issued in the name of Morton, discloses an ornamental design for a toy box.

Consequently, a need has been felt for providing an apparatus and method which overcomes the problems cited above.

SUMMARY OF THE INVENTION

It is therefore an object of the present invention to provide a toy storage apparatus having an outwardly projecting base supporting an upward and vertically extending storage container.

It is another object of the present invention to provide a toy storage apparatus having a lid placed on the opening formed in the top of the storage container, thereby sealing the contents therein and preventing the accumulation of dust and preventing unnecessary damage to the stored items.

It is another object of the present invention to provide a toy storage apparatus having a narrowed neck for impinging stored items.

It is another object of the present invention to provide a toy storage apparatus having a reservoir for receiving and housing stored items that fall from the narrow neck.

It is another object of the present invention to provide a toy storage apparatus having an enclosure for accessing the contents of the reservoir.

Briefly described according to one embodiment of the present invention, a toy storage apparatus comprises a base coupled with a storage container, with a reservoir and neck therebetween. The storage container is an upward and vertically extending member that includes a flip-top lid for closing and opening the top of the container. The stored items placed within the container are subject to gravitational forces, thereby pulling the items toward the narrowed neck and impinging therein. The reservoir collects any items that fall from the narrowed neck and are accessed by an enclosure formed on the reservoir. The base engages the reservoir and container, and provides support to the container as it is weighted down with storage items by an outward projection from the perimeter of the reservoir.

Other objects of the present invention include providing a device that is portable, lightweight, color coordinated, transparent or opaque and easily maintained.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
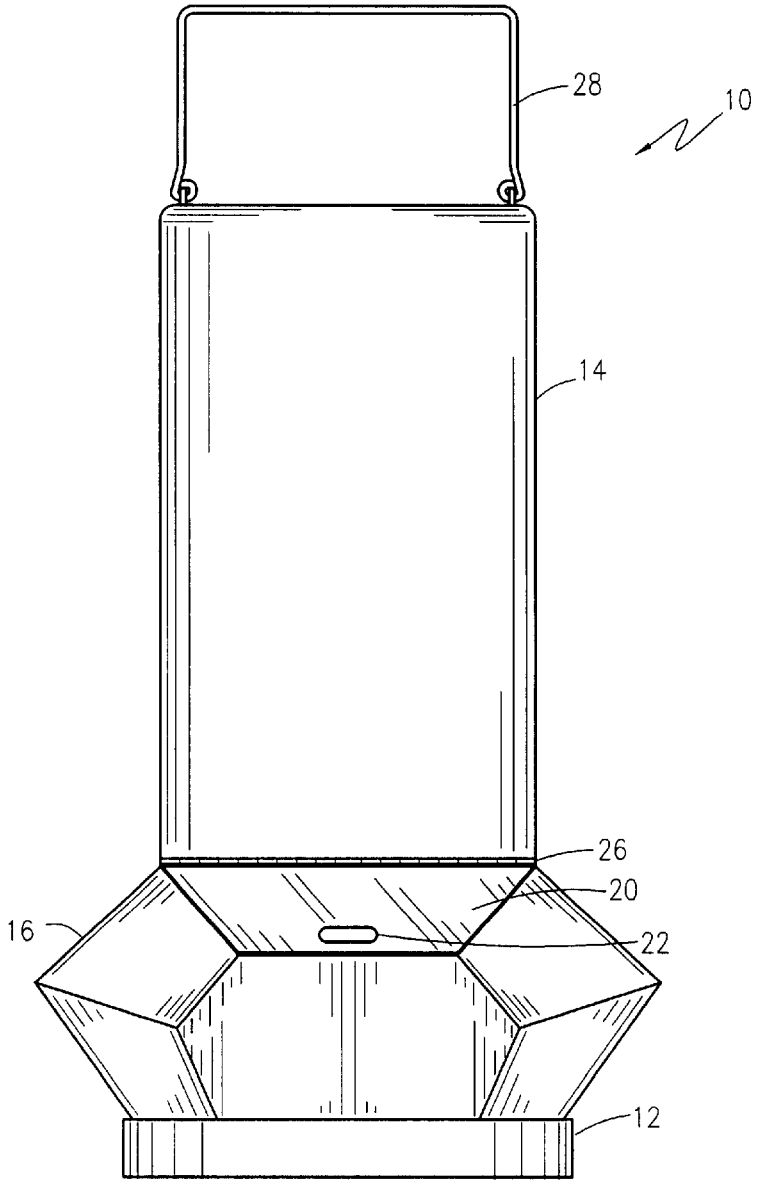
FIG. 1 is a front elevational view of the toy storage apparatus.
Figure 2:
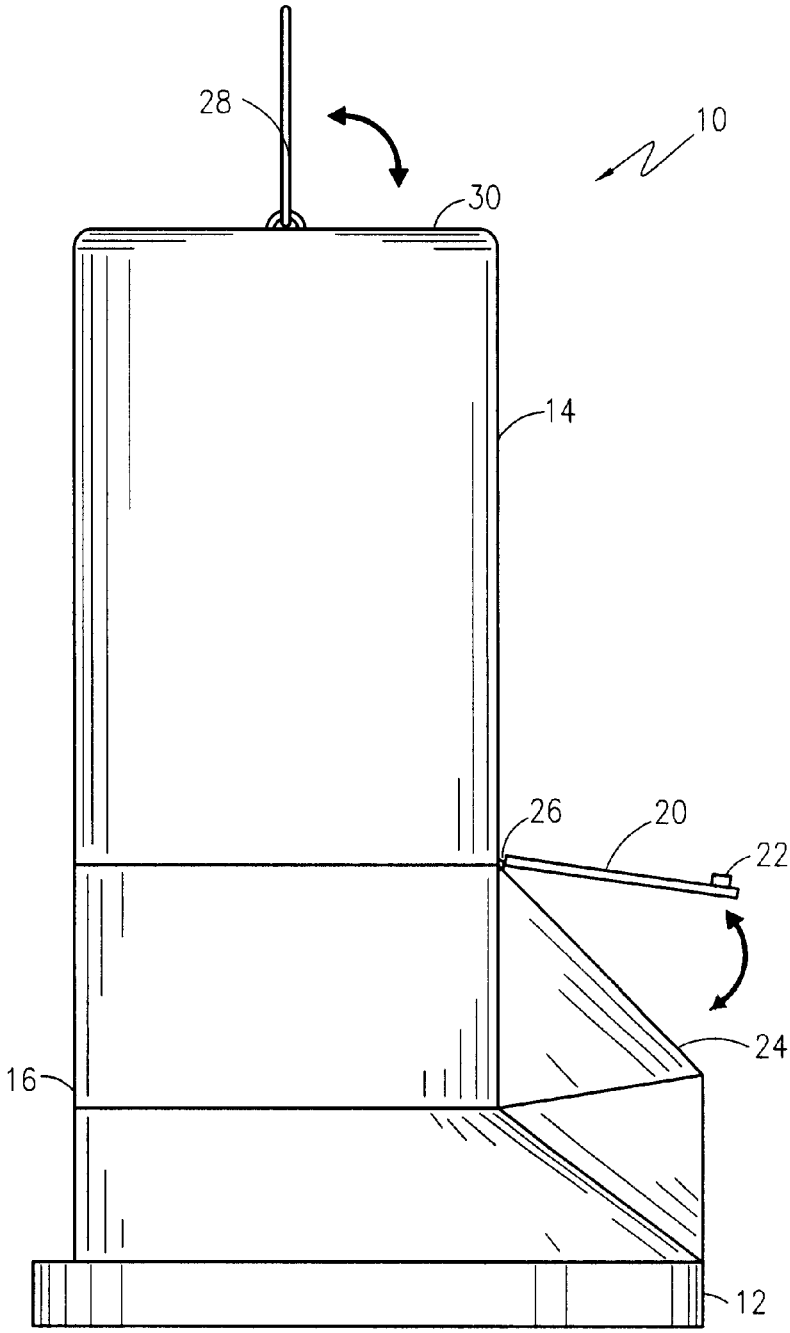
FIG. 2 is a side elevational view of the toy storage apparatus.

The best mode for carrying out the invention is presented in terms of its preferred embodiment, herein depicted within the FIGS. 1 and 2.

1. Detailed Description of the Figures

Referring now to FIG. 1 and FIG. 2. a new toy storage apparatus 10 is shown in accordance with the preferred embodiment of the present invention. The toy storage apparatus 10 comprises a base 12 supporting a storage container 14.

The base 12 is either detachably affixed or integrally affixed to a reservoir 16 accessed via a recessed opening 18. The reservoir 16 may have:a variety of geometric configurations, including spherical or polygonal, best suited for the storage environment. The recessed opening 18 may be covered by a pivoting enclosure 20 with a handle 22. The base 12 may assume a variety of geometric configurations, including circular, triangular, quadrilateral or other polygonal forms.

The storage container 14 is an upwardly, vertically extending member coupled with the reservoir 16 and base 12 about a neck 26, intermediate therebetween. The neck 26 provides the attachment point between the radially extended reservoir 16 and the container 14 sidewall. As the container 14 is filled with items, gravity acts to pull the already stored items past neck 26 to outwardly fill the reservoir 16. The reservoir 16 traps stored items until released by. force or through gravity. The storage container 14 includes a lid 28 provided at the top portion of the container 14 to cover the opening 30 formed at the top of the container 14. The lid 28 allows access to the stored items, allows for insertion of other items, and provides closure means for securing the contents therein. It is envisioned that the lid 28 may have a variety of configurations including the flip-top version depicted in FIG. 1 and FIG. 2, or a sealable version (not shown) having a channel formed about the outer perimeter and receiving the upper lip of the container 14 and thereby sealing the contents.

It is envisioned that the apparatus 10 is constructed from a durable material, such as any number of plastics, and formed from an injection molding technique. The container 14 may have a number of exterior surface characteristics, wherein the container 14 is transparent, translucent, opaque or a coordinated color scheme. Likewise, the reservoir 16 is envisioned to have the same or similar exterior surface characteristics discussed in relation to the container 14. The base 12 may include a solid color coordinated for the room or the overall aesthetic of the apparatus 10. The lid 28 is envisioned to have the same qualities and characteristics as the base 12, and to have a complimentary color coordination, wherein the colors are identical or properly coordinated.

It is further envisioned that the apparatus 10 may assume a number of configurations to address space constraints within a particular room, such that the apparatus 10 may be configured to suitably adapt to a corner of a room. Furthermore, the apparatus 10 might be configured so that a plurality of apparatuses 10 are placed as a bank of toy storage apparatuses 10 within a single room, and may be particularly suitable for child daycare facilities, schools, or other similar places.

2. Operation of the Preferred Embodiment

To use the present invention, a user will remove or pivot the lid 28 to access the interior of the container 14, thereby placing a desired items for storage therein. The user will then attach or affix the lid 28 back into a position that encloses the contents of the storage container 14, thus preventing dust accumulation and/or damage to the toys. When the toy(s) are to be accessed, the enclosure 20 may be pivoted to open and provide access to the reservoir 16, thereby allowing access to the stored items. If the desired item is within the storage container 14, the user may release the toys impinged within the neck 26 and release the items into the reservoir 16, and then sifting through the items until the desired choice is found.

The foregoing description is included to illustrate the-operation of the preferred embodiment and is not meant to limit the scope of the invention. The scope of the invention is to be limited only by the following claims.

What is claimed is:

1. A toy storage apparatus comprising:

a vertically disposed storage volume bounded by a container sidewall and terminated at a lowermost end by a neck;

a reservoir radially extended from said container sidewall and affixed to said neck;

a base affixed to said reservoir; and a recessed opening formed by said reservoir, said recessed opening covered by a pivoting enclosure with a handle.

2. The toy storage apparatus of claim 1, wherein said storage volume comprises a storage container forming an upwardly, vertically extending member coupled with said reservoir.

3. The toy storage apparatus of claim 1, wherein said vertically disposed storage volume and said reservoir are transparent.

* * * * *